US008772983B2

(12) United States Patent
Filippenko et al.

(10) Patent No.: US 8,772,983 B2
(45) Date of Patent: Jul. 8, 2014

(54) CONTROL CIRCUIT FOR MOTORIZED CIRCUIT BREAKER

(75) Inventors: Alexander Filippenko, Cary, NC (US); Scott Brown, Wake Forest, NC (US)

(73) Assignee: Schneider Electric USA, Inc., Palatine, IL (US)

( * ) Notice: Subject to any disclaimer, the term of this patent is extended or adjusted under 35 U.S.C. 154(b) by 491 days.

(21) Appl. No.: 13/228,253

(22) Filed: Sep. 8, 2011

(65) Prior Publication Data

US 2013/0062971 A1 Mar. 14, 2013

(51) Int. Cl.
*H01H 3/00* (2006.01)

(52) U.S. Cl.
USPC ..... 307/139

(58) Field of Classification Search
USPC ..... 307/139
See application file for complete search history.

(56) References Cited

U.S. PATENT DOCUMENTS 7,598,629 B2 10/2009 Brown et al.

FOREIGN PATENT DOCUMENTS

| | | | |
|---|---|---|---|
| CN | 102005341 | A | 4/2011 |
| GB | 415285 | A | 8/1934 |
| JP | 5325772 | A | 12/1993 |

OTHER PUBLICATIONS

International Search Report mailed Dec. 13, 2012 in re PCT Application No. PCT/US2012/053895 filed Sep. 6, 2012.

*Primary Examiner* — Robert L. Deberadinis
(74) *Attorney, Agent, or Firm* — Coats and Bennett, P.L.L.C.

(57) ABSTRACT

A circuit breaker module includes an electrically controlled actuator, such as a DC motor, operable to move a breaker contact between open and closed positions. An actuator power supply circuit coupled to an AC power source is configured to selectively energize the actuator, responsive to an actuation input. A processing circuit is configured to control the actuator power supply circuit to activate the actuator in response to breaker command signals, using the actuation input. The processing circuit is further configured to delay activations of the actuator as needed to enforce a predetermined cooling interval between successive actuations.

12 Claims, 5 Drawing Sheets

CONTROL CIRCUIT FOR MOTORIZED CIRCUIT BREAKER

BACKGROUND

The invention relates to circuit breaker devices, and more particularly to control circuits for remotely controllable, motorized circuit breakers.

Circuit breakers are typically found in load centers, service entrance boxes or auxiliary circuit panels and are generally intended for manual operation by humans. However, remote or automatic operation of the circuit breaker may be required or desirable in some applications. In these situations, a remotely controlled circuit breaker can be used. Remotely controlled circuit breakers generally include an electrically controlled actuator, such as a motor or solenoid, which operates a movable contact inside the circuit breaker in response to a remotely generated operating signal. A circuit breaker controller provides the remotely generated operating signal to activate the actuator, to switch the circuit breaker on or off.

The controller may be located inside the load center or at some remote location outside the load center. The controller can have one or more ports or terminal sets, each being connectable to the control wires of one remotely controlled circuit breaker. In its simplest form, the controller simultaneously controls the OPEN/CLOSE operation of the controlled contacts in all remotely controlled circuit breakers connected to the controller. In a more sophisticated controller, connected circuit breakers can be operated in a particular time sequence, connection sequence, or independently, depending on parameters provided in the controller's programming.

U.S. Pat. No. 7,598,629, issued 6 Oct. 2009, of common ownership herewith, describes one such remotely controllable, motorized circuit breaker. This device includes a DC motor configured to open and close the circuit breaker's contacts in response to externally supplied control signals. The described device, however, includes a controller circuit and power supply circuit that are external to the circuit breaker module. More tightly integrated devices are desirable.

SUMMARY

The available space inside the housing of a circuit breaker is very limited, as it is constrained by the standardized dimensions of the housing. Furthermore, it is not feasible to reduce the size of many of the electrical conductors and electromechanical components in the circuit breaker, due to the high and continuous electrical currents that these components must handle, over a wide range of operating temperatures. Nevertheless, with the techniques disclosed herein, a power-supply circuit capable of opening and closing a circuit breaker by remote control can be fit into the tight confines of a standard-sized circuit breaker.

Accordingly, in several embodiments of the present invention a power-supply circuit for driving an electrically controlled circuit breaker mechanism is miniaturized so that it can be included in a circuit breaker housing, eliminating the need for an external DC power supply. A wireless transceiver is also included in some embodiments, permitting remote control of the electrically controlled circuit breaker.

More particularly, one embodiment of the present invention is a circuit breaker module that includes an electrically controlled actuator, such as a DC motor, operable to move a breaker contact between an open position, preventing current flow from an AC power source through the circuit breaker, and a closed position, permitting current flow. An actuator power supply circuit is coupled to the AC power source and configured to selectively energize the actuator, responsive to an actuation input. The circuit breaker module also includes a processing circuit that is configured to control the actuator power supply circuit to activate the actuator in response to breaker command signals, using the actuation input. The processing circuit is further configured to delay activations of the actuator as needed to enforce a predetermined cooling interval between successive actuations. Finally, the circuit breaker module includes a housing, which contains the actuator, actuator power supply circuit, and the processing circuit.

In some embodiments, the actuator power supply circuit includes a current limiting resistor that has a continuous power rating less than the average power dissipated by the current limiting resistor during any activation of the actuator. In these embodiments, the predetermined cooling interval is selected to ensure that the average power dissipated by the current limiting resistor through successive activations of the actuator remains below the continuous power rating. In some cases, the current limiting resistor is in series with the actuator and a triac, the triac having a gate coupled to the actuation input. In these embodiments, the processing circuit is configured to activate the actuator by selectively triggering the triac during alternate half-cycles of the AC power source for the duration of each activation.

Any of the circuit breaker modules summarized above can also include a wireless receiver circuit contained within the housing and configured to receive wirelessly transmitted breaker commands. The wireless receiver circuit then generates the breaker command signals for controlling the electrically controlled actuator in response to the received breaker commands.

Various other aspects and embodiments of the invention are also disclosed herein, each of which may be used alone or in any combination.

DETAILED DESCRIPTION

Figure 1:
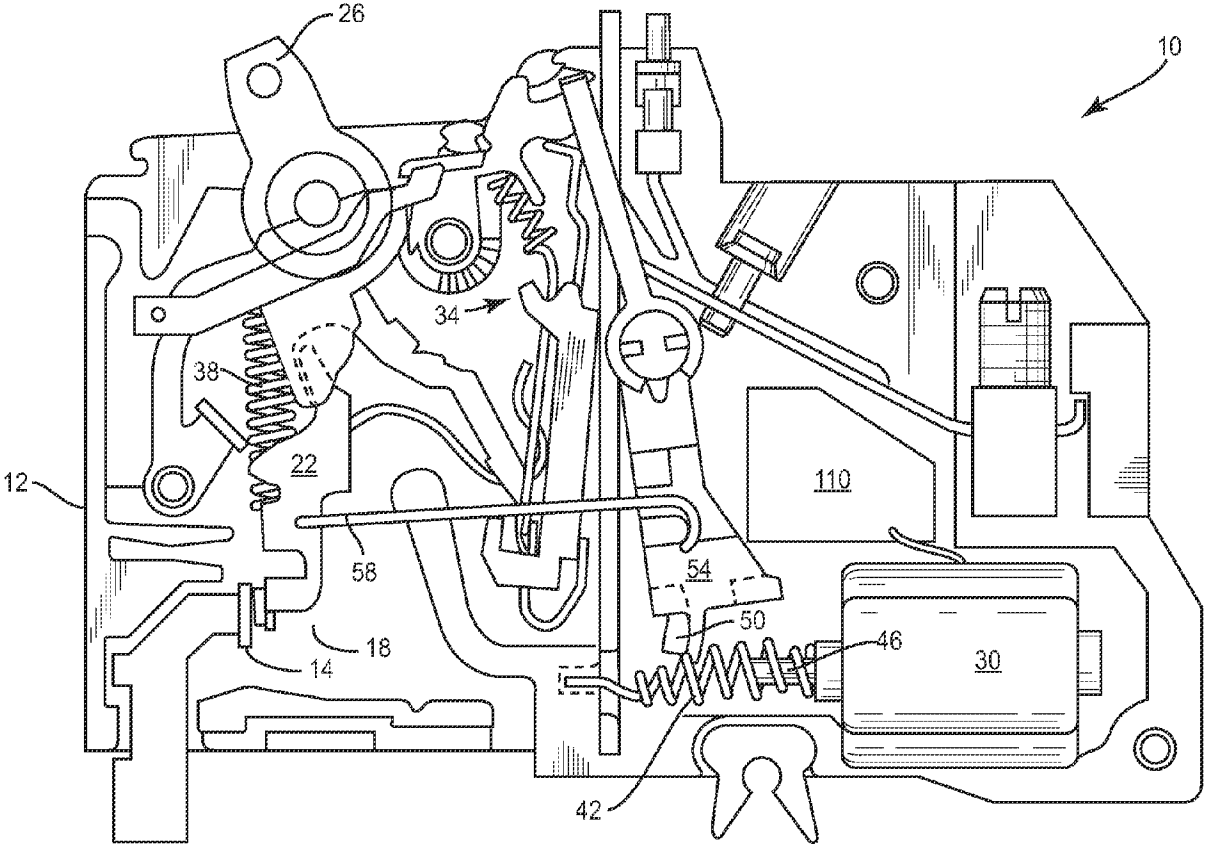
FIG. 1 illustrates in general an internal view of a remotely controlled circuit breaker (contacts CLOSED) according to some embodiments of the present invention.

In several embodiments of the present invention, a power-supply circuit for driving an electrically controlled circuit breaker mechanism is included entirely within a circuit breaker housing, eliminating the need for an external DC power supply. A wireless transceiver is also included in some embodiments, permitting remote control of the electrically controlled circuit breaker. The resulting circuit breaker is suitable for various home automation and power efficiency applications, among other uses.

More particularly, a circuit breaker module includes an electrically controlled actuator, such as a DC motor, operable to move a breaker contact between open and closed positions. An actuator power supply circuit coupled to an AC power source is configured to selectively energize the actuator, responsive to an actuation input. A processing circuit is configured to control the actuator power supply circuit to activate the actuator in response to breaker command signals, using the actuation input. The processing circuit is further configured to delay activations of the actuator as needed to enforce a predetermined cooling interval between successive actuations. This permits several components of the actuator power supply circuit to be smaller than would be necessary if continuous operation of the actuator were permitted, facilitating the inclusion of the entire circuit within the circuit breaker housing.

Before several embodiments of the invention are explained in detail, it should be understood that the invention is not limited in its application to the details of construction described herein or as illustrated in the drawings. Likewise, the invention is not limited to any particular supply voltage or circuit breaker current. Thus, for example, while details of a circuit for controlling a 240 VAC, two-phase circuit breaker are shown, it should be understand that the same techniques and circuits may be adapted to other supply voltages and to other circuit breaker configurations, such as a 120 VAC, single-phase circuit breaker. Further, it is to be understood that the phraseology and terminology used to describe particular examples of the invention is for the purpose of description and should not be regarded as limiting.

Figure 2:
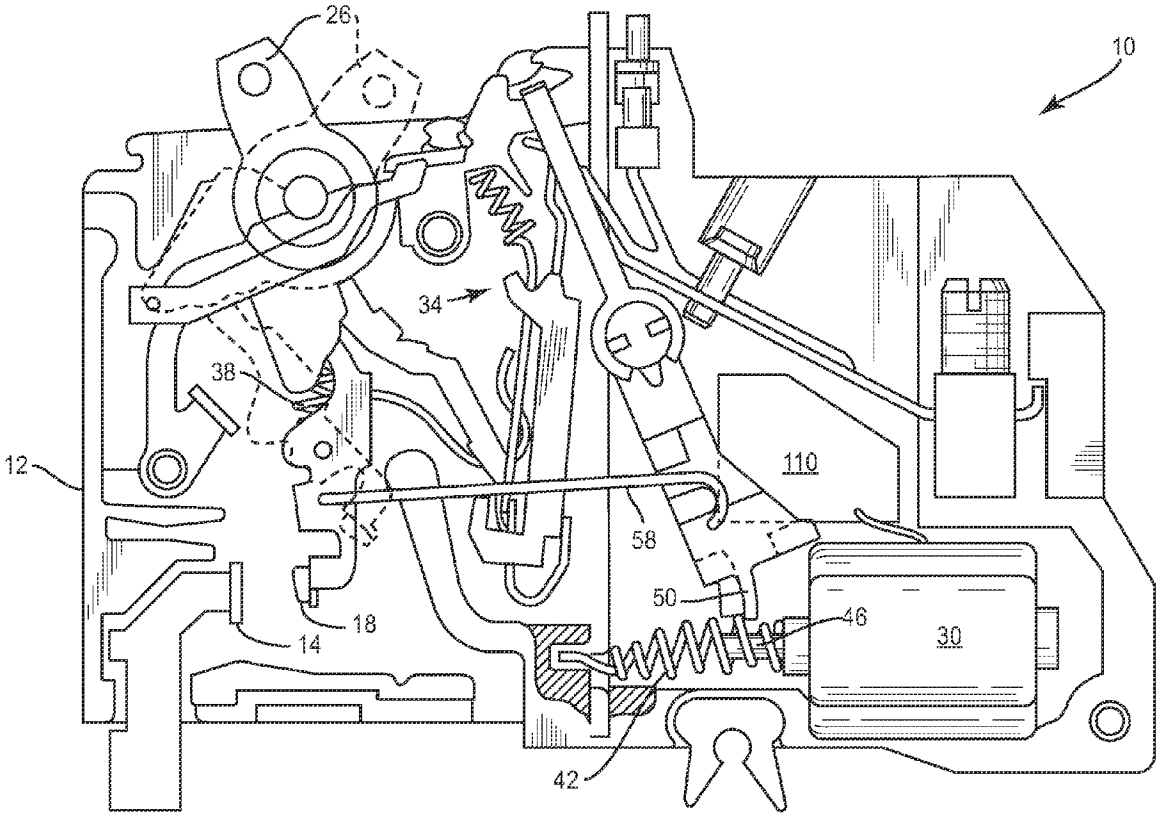
FIG. 2 illustrates the remotely controlled circuit breaker of FIG. 1, but with contacts OPEN.

FIGS. 1 and 2 illustrate a remotely controlled circuit breaker generally indicated by reference numeral 10. A comprehensive description of a circuit breaker similar in many respects to circuit breaker 10 can be found in U.S. Pat. No. 4,623,859, of common ownership herewith and of which the entire contents are incorporated herein by reference; thus only those components required for understanding the present invention will be described herein.

Breaker 10 includes housing 12, at least one stationary contact 14, and at least one movable contact 18. The movable contact 18 is attached to a pivotably supported carrier 22. The stationary contact 14 and movable contact 18 are electrically in series between a power source and a load, such that when the movable contact 18 is in a contact CLOSED position (FIG. 1), the load is electrically connected to the source. On the other hand, when the movable contact 18 is in a contact OPEN position (FIG. 2), the load is disconnected from the source.

The carrier 22 and its attached movable contact 18 are movable between the contact CLOSED position and the contact OPEN position locally, by manual operation of handle 26, or remotely, by an electrically controlled actuator such as a motor 30 that can be remotely controlled. The movable contact 18 can also be moved from the contact CLOSED position to the contact OPEN position by an overload trip mechanism 34.

The movable contact 18 is maintained in the contact CLOSED position by an over center biasing spring 38, which also maintains the contact OPEN position (dashed lines in FIG. 2) when operated by either the handle 26 or overload trip mechanism 34. The contact OPEN position resulting from operation of the motor 30 (solid lines in FIG. 2), places the movable contact 18 at a position between the contact CLOSED position and the spring biased contact OPEN position. This intermediate position is a sufficient distance from the stationary contact 14 to prevent current flow and/or arcing between the stationary contact 14 and movable contact 18, but not past the equilibrium position of biasing spring 38. From this position only, motor 30 can move the movable contact 18 to the contact CLOSED position of FIG. 1. Thus, in the embodiment shown in FIGS. 1 and 2, motor 30 can only close the contacts if motor 30 previously opened them. In an embodiment where the motor is remotely controlled, this prevents remotely generated commands from over-riding a local decision to manually open the contacts, and prevents a remote command from closing the contacts after the breaker has tripped. Of course, other configurations are possible.

Motor 30 is operated by a DC current, with the direction of rotation (clockwise or counter clockwise) being determined by the polarity of the DC current applied to the motor 30. A gear spring 42 is attached to the motor shaft 46 for common rotation therewith. The gear spring 42 engages a tooth 50 on the end of an actuator 54 such that the actuator 54 is moved back and forth in a pivotal arc as the motor shaft 46 is operated in clockwise and counterclockwise directions. Arcuate movement of the actuator 54 is transferred to the carrier 22 by an operating rod 58. Starting from the movable contact CLOSED position of FIG. 1; rotation of the motor shaft 46 in the clockwise direction will cause the actuator 54, operating rod 58, carrier 22 and attached movable contact 18 to be drawn away from the stationary contact 14 to the movable contact OPEN position of FIG. 2 (solid lines). To operate the movable contact 18 from the contact OPEN position to the contact CLOSED position the polarity of the DC voltage applied to the motor 30 is reversed, thus reversing the operation described above.

Various means may be used to turn off motor 30 after the movable contact 18 has been moved the appropriate distance. U.S. Pat. No. 7,598,629, issued Oct. 6, 2009 ("the '692 Patent") describes one approach, which includes a circuit for detecting the current state of the motor and the breaker circuit connections. The entire contents of the '692 Patent are incorporated by reference herein, for further background. With the approach shown in the '692 Patent, after the movable contact 18 has reached the movable contact OPEN position or CLOSED position, a motor shut off switch (not shown) disconnects the motor 30 from the DC power source. Other approaches are possible, whether involving circuits that detect actuator movement and/or contact position, or that monitor the time of operation of the motor, or that perform some combination of both.

In the circuit breaker system described in the '692 Patent, the remotely controlled motor is driven by a DC current supplied from a power supply that is external to the circuit breaker module itself. The switching of the remotely controlled circuit breaker requires substantial energy, as heavy contacts must be moved against a strong spring. Thus, one solution is to use an external power supply, as described in the '692 Patent, such as a QOPLPS 240 VAC to 24 VDC, 2A@50 mS power, SQUARE D brand supply provided by Schneider Electric. This external power supply is capable of supplying sufficient energy needed to switch a QOPL breaker (also SQUARE D brand) which might require approximately 2 Amps at 24 VDC for about 35 to 40 milliseconds. However, such a power supply takes two spaces in a typical load center, and requires some wiring to connect it to the motorized circuit breaker itself.

The circuit breaker 10 illustrated in FIGS. 1 and 2 instead includes a circuit board 110 that in turn carries an actuator power-supply circuit. This power-supply circuit eliminates the need for an external power supply, instead locating the power supply inside of the breaker housing 12. When this internal power supply is coupled to a controller and a radio for receiving remote control commands, the result is a self-contained, remotely controllable, motorized circuit breaker.

The available space inside the housing 12 of circuit breaker 10 is very limited, as it is constrained by the standardized dimensions of the housing. Furthermore, it is not feasible to reduce the size of many of the electrical conductors and electro-mechanical components in the circuit breaker, due to the high and continuous currents that these components must handle. Nevertheless, using the techniques disclosed herein, a power-supply circuit able to supply sufficient power to energize the motor 30 for a sufficient length of time to open or close the contacts is possible, provided that the motor 30 is not permitted to open and close the contacts in rapid succession. By enforcing this limitation, smaller components can be used in this power supply, as they need not be rated for continuous operation at the high currents required by the motor 30. In effect, one or more of these components is operated in an overload mode, but only for controlled intervals of time.

More particularly, the power-supply control circuit enforces a "cool-down" interval between successive activations of the motor 30. With appropriately sized components in the power-supply circuit, this pre-determining cooling interval allows the average power dissipated by each component through successive activations of the motor 30 to remain below the continuous power rating for that component. Thus, smaller components may be used, without overheating and/or damage, allowing the entire power-supply circuit to be fit into the limited volume of the circuit breaker housing.

Figure 3:
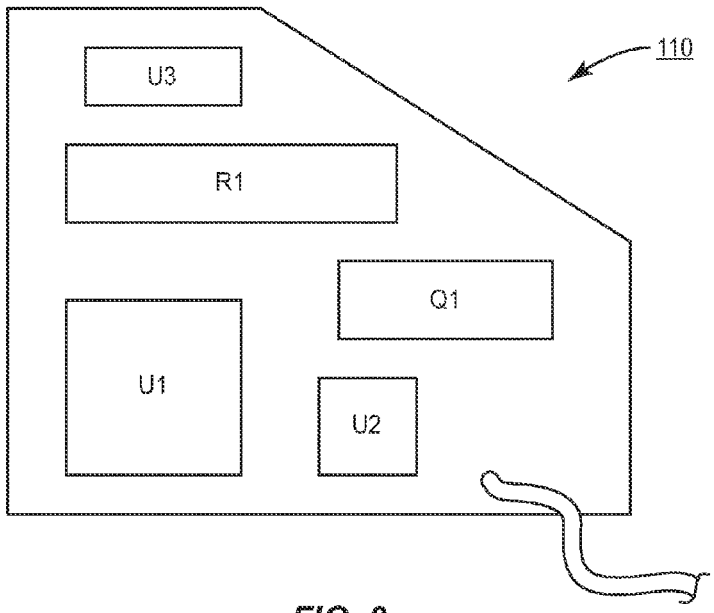
FIG. 3 illustrates an example layout for a control circuit board suitable for use in some embodiments of the present invention.
Figure 4:
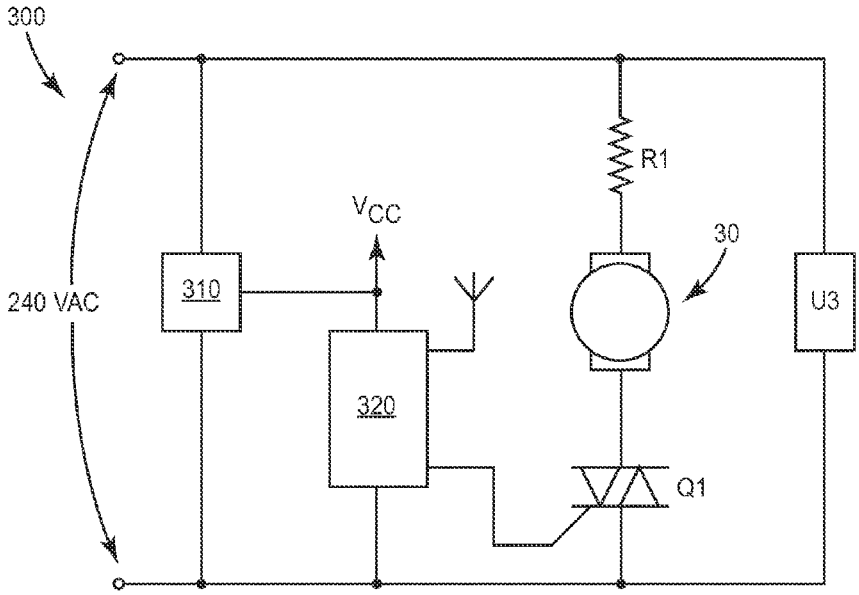
FIG. 4 is a schematic diagram illustrating several components of an example circuit breaker control circuit.

FIG. 3 illustrates an example physical layout for several of the larger components in some embodiments of the actuator power-supply control circuit, while FIG. 4 is a schematic diagram illustrating the general electrical configuration of several embodiments. FIG. 5 is a detailed schematic for one example implementation of the circuit illustrated more generally in FIG. 4.

Referring first to FIG. 4, the illustrated embodiment of an actuator power-supply and control circuit 300 uses a pulse current source for driving a DC motor 30. A similar current source may be used for driving another type of electrically controlled actuator, such as a solenoid. In circuit 300, the source is a wire-wound current-limiting resistor R1 that is capable of sustaining one pulse of sufficient power to switch the breaker into desired position, e.g., about 2 Amps for 40 milliseconds. Resistor R1 may be about 120 ohms, in some embodiments, in which case it is dissipating 500 watts when the motor 30 is running. Resistor R1 need not be rated for 500 watts of continuous power dissipation, but can be rated for considerably lower power, and thus can be smaller than would otherwise be required. Between successive activations, however, this smaller resistor R1 requires a cooling interval, so that the average current through the resistor is below the maximum it can sustain without damage.

Generally speaking, this allows the power rating for resistor R1 to be well below the maximum peak power that it dissipates, so long as the resistor's power rating is above the average dissipated power across several successive activations. Of course, along with the length of the cooling interval, normal design considerations must also be weighed in selecting the appropriate resistor R1, such as the operating temperature range, the quality and size of the device's thermal connections to a heat sink or heat-spreading material, and so on. The length of the cooling interval might be one minute, in some embodiments, but could be longer or shorter depending on the size of the resistor and its ability to shed heat to the surrounding environment in a particular design.

The power-supply circuit 300 is controlled by a processing circuit 320, which is a microcontroller, microprocessor, field-programmable gate array, or other processing circuit. Processing circuit 320 may include or may be combined with a radio to allow remote control of the circuit. Examples of available system-on-a-chip solutions that are suitable for processing circuit 320 include the Zigbee®-compatible CC2530 from Texas Instruments or Freescale Semiconductor's MC13224. Each of these solutions includes sufficient flash memory for application-specific programming and can thus be programmed to carry out the power-supply control functionality described herein. Each of these solutions also includes an integrated RF transceiver and are pre-programmed with a protocol stack for the IEEE® 802.15.4 Zigbee standards. Thus, these solutions include an integrated solution for wireless remote control operation. Of course, other controller solutions without integrated radio devices could also be used, and may be coupled to separate radio devices if wireless remote control is desired.

Circuit 300 further includes a low-power supply 310 for supplying the proper voltage, e.g., 3.3V, to the processing circuit 320. Power supply 310 can in turn be powered by the AC line voltage entering the circuit breaker 10 from the "hot" side. In the illustrated example, this is 230/240 VAC. Details of one example configuration for power supply 310 are given in FIG. 5 and will be described in further detail below. Generally, power supply 310 provides power only for the processing circuit 320. Processing circuit 320 can be configured to spend most of its time in a "sleep" mode; thus, the average current required from power supply 310 can be well under one milliamp, at a typical voltage of 3.3 VDC.

In the circuit of FIG. 4, the high-power circuit for driving the motor 30 includes the resistor R1, discussed earlier, as well as a triac Q1. Triac Q1 is selectively triggered by processing circuit 320 to select either positive or negative half-cycles of the 230 VAC supply, to provide a DC current through motor 30. A varistor U3, such as a metal-oxide varistor (MOV), limits the voltage on triac Q1 so that it stays under the triac's break-down voltage, to protect against unintended motor operations during power transients on the AC supply. It should be noted that triac Q1, like resistor R1, can be sized so that its maximum continuous power dissipation capability is below the peak power dissipation that it handles during a single activation of motor 30. Once again, this is because processing circuit 320 is configured to enforce a cooling interval between successive activations, as described in further detail below.

Figure 5A:
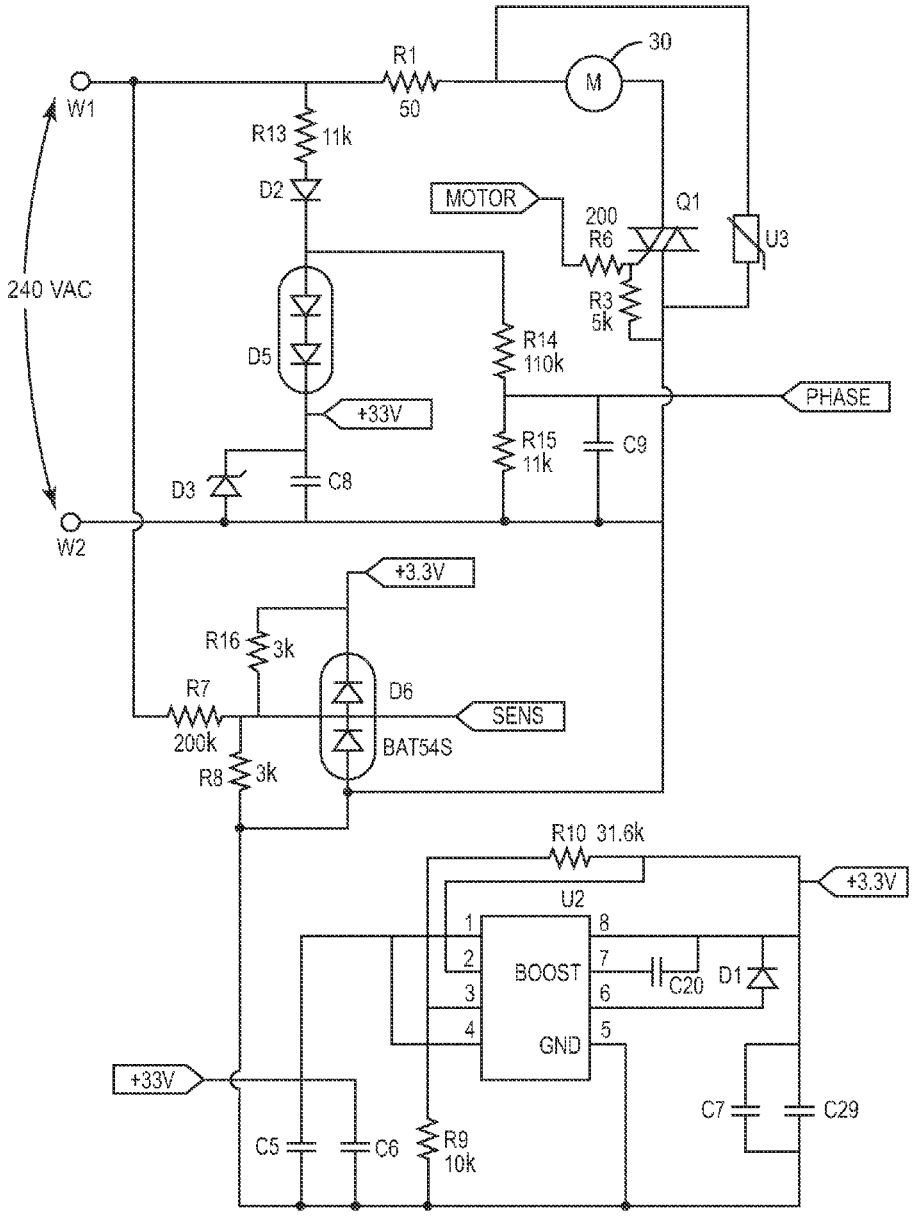
FIG. 5 is a schematic diagram illustrating details of one embodiment of a circuit breaker control circuit according to some embodiments of the present invention.
Figure 5B:
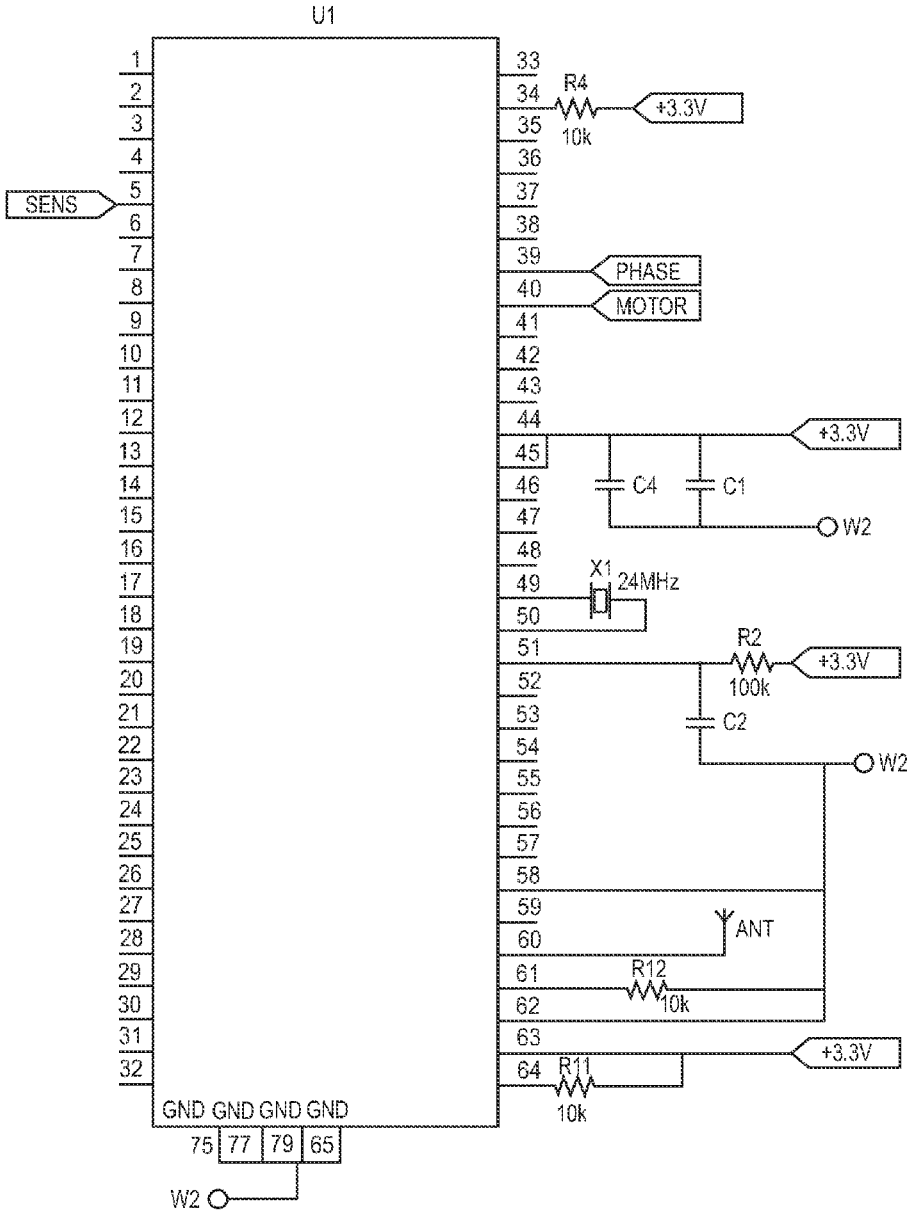

Further details of an example actuator power supply and control circuit are given in FIGS. 5A and 5B. In this example circuit, the processing circuit 320 is implemented using an MC13224 microcontroller from Freescale Semiconductor, illustrated as component U1 in FIG. 5B. As noted earlier, this device includes a Zigbee-compatible radio transceiver and protocol stack; the radio has an antenna connection at pin 60. A crystal oscillator X1, at pins 49 and 50, clocks the controller, which is powered by a 3.3 VDC supply at pins 44 and 45.

The 3.3 VDC is provided from a step-down switching voltage regulator U2, shown in FIG. 5A. One possibility for this component is the LT3502 from Linear Technologies, which is available in a very small 2 mm by 2 mm package. Voltage regulator U2 is in turn supplied by a 33 VDC supply derived from the 240 VAC input at node W1, using zener diode D3.

Another feature of the circuit in FIG. 5A is its ability to sense the phase of the 240 VAC input at node W1. The PHASE signal in FIG. 5A (which is supplied to controller U1 in FIG. 5B) is derived from the 240 VAC input through diode D2 and resistors R13, R14, and R15. Diode D2, operating in conjunction with diodes D5 and zener diode D3, limits current through the resistor divider network formed by R14 and R15 to a single direction. These resistor values are selected so that PHASE has a maximum level of about 3.3 volts; PHASE is high when the 240 VAC signal is in a positive half-cycle, and low otherwise.

Another feature of the circuit in FIG. 5A is a supply voltage measurement circuit, comprising resistors R7, R8, and R18, and dual Schottky diode D6. The output signal SENS provides a measurement of the AC supply voltage to controller U1. This measurement signal may be used to determine that the supply voltage is abnormally low, in some embodiments, in which case remote switching of the circuit breaker to the ON position may be disallowed.

In operation, controller U1 receives a command to switch via the built-in Zigbee radio transceiver. The controller is configured (with appropriate program code) to wait until the PHASE input line indicates the beginning of a half-cycle of the proper polarity voltage, either positive or negative, depending on how the DC motor is connected. (Depending on how it is connected, a DC current generated from positive half-cycles may drive the motor to close the contacts or open them, while a DC current generated from negative half-cycles will have the opposite effect.) At the beginning of an appropriate half-cycle (positive or negative), the controller triggers the triac Q1. The triac Q1 then conducts current for the duration of that half-cycle. The microcontroller repeats triggering on successive instances of the appropriate half-cycle (positive or negative), until the contacts have been opened or closed, as appropriate.

In some embodiments, this may simply be for a pre-determined duration known to be sufficient to move the movable contact far enough. For instance, in the Square D QOPL breaker discussed earlier, about 35 milliseconds is sufficient. In other embodiments, the control circuit may be further configured to detect the physical state of the movable contact; this state information may be used instead of or in addition to a pre-determined activation duration.

Once the activation cycle is complete, the microcontroller in U1 returns to "sleep" mode, thus reducing the power needs of the control circuit to a minimum. Importantly, the microcontroller is configured so that it does not allow execution of any subsequent command until the cooling of the limiting resistor R1 and/or triac Q1 is completed. Thus, the microcontroller is programmed to enforce a pre-determined cooling interval—if another command to energize motor 30 is received before the cooling interval, execution is either suppressed entirely (i.e., the command is ignored), or execution is delayed until the cooling interval has expired. As suggested earlier, the pre-determined cooling interval may be about one minute in some embodiments, but more generally the cooling interval may be longer or shorter depending on the component selection, the peak currents required by the electrically controlled actuator, and the physical design of the power-supply circuit.

It will be appreciated that by selecting positive or negative half-cycles of the source voltage, the motor can be selectively operated in both directions. Thus, the circuit breaker can be operated in a desired direction, responsive to a received command. Generally, the duration of a transition (the duration of the energizing of the motor) is pre-selected to be somewhat longer than needed to complete switching, for a particular breaker mechanism. This duration may be the same for both opening and closing operations, or it may differ, depending on the physical configuration of the breaker.

In the circuit illustrated in FIG. 5, commands triggering opening and closing of the breaker via the motor are remotely generated and wirelessly transmitted to the Zigbee receiver. Controller U1 can be programmed to send confirmation commands, if desired, and can be programmed with security protocols to prevent unauthorized control of the device; these security protocols can range from simple, password-based schemes to more elaborate schemes that employ encryption, authentication, and/or digital certificate technologies. In addition to or instead of responding to wireless remote control commands, controller U1 (in FIG. 5) or controller 320 (in FIG. 4) can configured to respond to control signals generated by switches and/or buttons installed on the breaker itself. However, locating the entirety of the controller inside the breaker housing allows the use of a non-isolated power supply. Accordingly, isolating the control inputs, either wirelessly or optically, is generally desirable.

In the preceding description, several embodiments of the present invention were described in detail. However, the various aspects of the various embodiments may be found individually in various embodiments, or in any combination. Indeed, the present invention may be carried out in other specific ways than those herein set forth without departing from the scope and essential characteristics of the invention. The present embodiments are, therefore, to be considered in all respects as illustrative and not restrictive, and all changes coming within the full scope of the appended claims are intended to be embraced therein.

What is claimed is:

1. A control circuit for a circuit breaker, the control circuit comprising:

an electrically controlled actuator operable to move a breaker contact between an open position, preventing current flow from an AC power source through the circuit breaker, and a closed position, permitting current flow;

an actuator power supply circuit coupled to the AC power source and configured to selectively energize the actuator, responsive to an actuation input; and a processing circuit configured to:

control the actuator power supply circuit to activate the actuator in response to breaker command signals, using the actuation input; and delay activations of the actuator as needed to enforce a predetermined cooling interval between successive actuations.

2. The control circuit of claim 1, wherein the actuator power supply circuit includes a current limiting resistor with a continuous power rating less than the average power dissipated by the current limiting resistor during any activation of the actuator, and wherein the predetermined cooling interval ensures that the average power dissipated by the current limiting resistor through successive activations of the actuator remains below the continuous power rating.

3. The control circuit of claim 2, wherein the current limiting resistor is in series with the actuator and a triac, the triac having a gate coupled to the actuation input, and wherein the processing circuit is configured to activate the actuator by selectively triggering the triac during alternate half-cycles of the AC power source for the duration of each activation.

4. The control circuit of claim 3, further comprising a phase sensing circuit coupled to the AC power source and configured to provide a phase sense output indicating the phase of the AC power source, wherein the processing circuit is configured to use the phase sense output to selectively trigger the triac during alternate half-cycles of the AC power source.

5. The control circuit of claim 1, wherein the actuator comprises a DC motor.

6. The control circuit of claim 1, further comprising a wireless receiver circuit configured to receive wirelessly transmitted breaker commands and generate the breaker command signals in response to the received breaker commands.

7. A circuit breaker module, comprising:

an electrically controlled actuator operable to move a breaker contact between an open position, preventing current flow from an AC power source through the circuit breaker, and a closed position, permitting current flow;

an actuator power supply circuit coupled to the AC power source and configured to selectively energize the actuator, responsive to an actuation input;

a processing circuit configured to:

control the actuator power supply circuit to activate the actuator in response to breaker command signals, using the actuation input, and delay activations of the actuator as needed to enforce a predetermined cooling interval between successive actuations; and a housing containing the actuator, actuator power supply circuit, and the processing circuit.

8. The circuit breaker module of claim 7, wherein the actuator power supply circuit includes a current limiting resistor with a continuous power rating less than the average power dissipated by the current limiting resistor during any activation of the actuator, and wherein the predetermined cooling interval ensures that the average power dissipated by the current limiting resistor through successive activations of the actuator remains below the continuous power rating.

9. The circuit breaker module of claim 8, wherein the current limiting resistor is in series with the actuator and a triac, the triac having a gate coupled to the actuation input, and wherein the processing circuit is configured to activate the actuator by selectively triggering the triac during alternate half-cycles of the AC power source for the duration of each activation.

10. The circuit breaker module of claim 9, further comprising a phase sensing circuit coupled to the AC power source and configured to provide a phase sense output indicating the phase of the AC power source, wherein the processing circuit is configured to use the phase sense output to selectively trigger the triac during alternate half-cycles of the AC power source.

11. The circuit breaker module of claim 7, wherein the actuator comprises a DC motor.

12. The circuit breaker module of claim 7, further comprising a wireless receiver circuit contained within the housing and configured to receive wirelessly transmitted breaker commands and generate the breaker command signals in response to the received breaker commands.

* * * * *